US011679950B2

(12) United States Patent
Kambara et al.

(10) Patent No.: US 11,679,950 B2
(45) Date of Patent: Jun. 20, 2023

(54) ROLL ACCOMMODATION UNIT, PROCESSING APPARATUS, AND ROLL SETTING METHOD

(71) Applicant: Horizon International Inc., Takashima (JP)

(72) Inventors: Kanta Kambara, Takashima (JP); Shigenobu Fukuda, Takashima (JP); Masaru Ochi, Takashima (JP)

(73) Assignee: Horizon International, Inc., Takashima (JP)

( * ) Notice: Subject to any disclaimer, the term of this patent is extended or adjusted under 35 U.S.C. 154(b) by 0 days.

(21) Appl. No.: 17/313,720

(22) Filed: May 6, 2021

(65) Prior Publication Data

US 2021/0354944 A1 Nov. 18, 2021

(30) Foreign Application Priority Data

May 13, 2020 (JP) ..... JP2020-084482

(51) Int. Cl.
*B65H 16/02* (2006.01)
*B65H 16/06* (2006.01)
(Continued)

(52) U.S. Cl.
CPC ..... *B65H 16/02* (2013.01); *B65H 16/04* (2013.01); *B65H 16/06* (2013.01); *B65H 16/106* (2013.01);
(Continued)

(58) Field of Classification Search
CPC ..... B65H 16/00; B65H 16/005; B65H 16/02; B65H 16/06; B65H 16/10; B65H 16/106;
(Continued)

(56) References Cited

U.S. PATENT DOCUMENTS 1,111,590 A * 9/1914 Jacobs ..... B65H 16/08 242/595.1
4,557,716 A 12/1985 Ottaviano
(Continued)

FOREIGN PATENT DOCUMENTS

CN 107140457 A * 9/2017 ..... B65H 16/02
EP 2030926 A2 3/2009
(Continued)

OTHER PUBLICATIONS

European Search Report dated Feb. 3, 2022 in corresponding application 21172644.3.
(Continued)

*Primary Examiner* — Michael R Mansen
*Assistant Examiner* — Raveen J Dias
(74) *Attorney, Agent, or Firm* — Muncy, Geissler, Olds & Lowe, P.C.

(57) ABSTRACT

A roll accommodation unit includes: a roll support shaft; a pair of side walls; and a pair of roll bearings that are attached to the pair of side walls, recessed portions are formed at upper ends of the pair of side walls, the pair of rolling bearings are attached to the side walls at positions corresponding to bottoms of the recessed portions such that the rolling bearings project upward beyond inclined surfaces of the recessed portions, the roll support shaft includes a support shaft main body, and a pair of small-diameter portions that are provided at both ends of the support shaft main body, and the roll support shaft is supported with the small-diameter portions abutting on outer circumferential surfaces of the pairs of rolling bearings in a state in which the support shaft main body is located at an interval from the recessed portions.

8 Claims, 9 Drawing Sheets

(51) Int. Cl.
*B65H 16/10* (2006.01)
*B65H 16/04* (2006.01)
*B65H 19/30* (2006.01)

(52) U.S. Cl.
CPC ..... *B65H 19/30* (2013.01); *B65H 2301/4135* (2013.01); *B65H 2301/41342* (2013.01); *B65H 2301/41369* (2013.01)

(58) Field of Classification Search
CPC ..... B65H 16/04; B65H 16/08; B65H 16/103; B65H 2301/413; B65H 2301/4134; B65H 2301/41342; B65H 2301/41344; B65H 2301/4135; B65H 2301/41361; B65H 2301/41362; B65H 2301/41369; B65H 2301/413665; B65H 18/02; B65H 18/026; B65H 18/028; B65H 18/04; B65H 18/06; B65H 19/30; B65H 19/305; B65H 75/40; B65H 75/403; B65H 75/42; B41J 15/00; B41J 15/04; B41J 15/042
USPC ..... 242/533, 533.8, 557
See application file for complete search history.

(56) References Cited

U.S. PATENT DOCUMENTS 4,650,456 A * 3/1987 Armington ..... B31D 5/0047 493/464
4,659,030 A * 4/1987 Graves ..... B65H 23/02 242/559.1
4,893,763 A * 1/1990 Wales ..... B65H 75/08 242/534
5,000,394 A * 3/1991 Wales ..... B65H 23/185 242/420.3
5,285,976 A 2/1994 Schmid et al.
5,470,030 A * 11/1995 Nielsen ..... B65H 23/1955 242/413.3
5,524,415 A 6/1996 Pachinger et al.
6,183,153 B1 * 2/2001 Kamoda ..... B65H 23/08 400/236.1
6,361,229 B1 * 3/2002 Shinga ..... B65H 16/06 400/613
6,561,453 B1 * 5/2003 Shinga ..... B65H 16/06 242/595.1
7,894,763 B2 * 2/2011 Itoh ..... B65H 19/12 400/613
7,950,602 B2 * 5/2011 Petri ..... B65H 16/06 242/559
8,191,816 B2 * 6/2012 Kaminaka ..... B65H 16/106 242/422.4
9,701,091 B2 * 7/2017 Page ..... B65H 23/06
10,059,069 B2 8/2018 Marchini et al.
10,577,208 B2 * 3/2020 Estella ..... B65H 16/06
10,752,458 B2 * 8/2020 Wind ..... B65H 16/028
11,414,285 B2 * 8/2022 Takahashi ..... B65H 16/02
2004/0011914 A1 1/2004 Gandini
2007/0063086 A1 * 3/2007 Itoh ..... B41J 15/042 400/692
2009/0065626 A1 * 3/2009 Petri ..... B65H 16/06 242/558
2009/0184193 A1 7/2009 Fischer et al.
2009/0272838 A1 * 11/2009 Kaminaka ..... B65H 16/106 242/615.3
2010/0054837 A1 * 3/2010 Sakai ..... B65H 16/06 400/613
2014/0097288 A1 * 4/2014 Yanase ..... B65H 75/30 242/564.5
2015/0165717 A1 * 6/2015 Page ..... B65H 23/06 242/594.6
2015/0343730 A1 * 12/2015 Marchini ..... B29D 30/30 242/554
2015/0360434 A1 * 12/2015 Van der Kaap ..... B31D 5/0043 242/598.5
2017/0233204 A1 * 8/2017 Gutierrez Garcia ..... F16H 37/0813 242/415
2018/0118492 A1 * 5/2018 Estella ..... B65H 16/06
2018/0186589 A1 * 7/2018 Wind ..... B65H 16/028
2020/0062524 A1 * 2/2020 Philipse ..... B41J 15/042
2020/0247153 A1 8/2020 Oda
2020/0270085 A1 * 8/2020 Takahashi ..... B65H 16/02
2022/0258497 A1 * 8/2022 Yato ..... B41J 15/02

FOREIGN PATENT DOCUMENTS

EP 2921442 A2 9/2015
EP 2938483 A1 11/2015
EP 3406771 A1 11/2018
JP H 03-95003 A 4/1991
JP H 09-52653 A 2/1997
JP 6381862 B1 8/2018
JP 2019-181780 A 10/2019

OTHER PUBLICATIONS

European Search Report dated Oct. 15, 2021 in corresponding application 21172644.3.
Japanese Office Action for Japanese Application No. 2020-084482 dated Jun. 24, 2020 with English translation.

* cited by examiner

ROLL ACCOMMODATION UNIT, PROCESSING APPARATUS, AND ROLL SETTING METHOD

CROSS-REFERENCE TO RELATED APPLICATIONS

This application is based on Japanese Patent Application No. 2020-84482, the contents of which are incorporated herein by reference in its entirety.

BACKGROUND

1. Technical Field

The present invention relates to a roll accommodation unit, a processing apparatus adapted to pull out a continuous sheet from a roll and performs processing thereon, and a roll setting method.

2. Description of Related Art

In the related art, apparatuses adapted to pull out continuous sheets from rolls and perform processing thereon such as an apparatus adapted to unwind a transfer paper from a transfer paper roll in the form of a continuous sheet, form images on the unwound transfer paper, then cut the transfer paper at every specific length, gather a predetermined number of cut transfer papers, and bind up the transfer papers into a book (see Japanese Unexamined Patent Application, Publication No. 9-52653, for example) and an apparatus adapted to unwind a label base paper from a label base paper roll in the form of a continuous sheet while separating the base paper into a surface paper and a release paper, perform stamping on the surface paper, and then attach the surface paper to the release paper again to manufacture a label continuous product (see Japanese Unexamined Patent Application, Publication No. 2019-181780, for example) are known.

Such an apparatus typically includes a roll accommodation unit that accommodates a roll of a continuous sheet such that the roll is rotatable about a horizontal axis.

The roll accommodation unit includes, for example, a roll support shaft 28 to which a roll 27 is attached and a pair of roll support arms 25 and 25 that are provided at a frame 24 of the apparatus and can horizontally support the roll support shaft 28 to which the roll 27 is attached as illustrated in FIG. 9.

Also, bearings 30 and 30 with a larger diameter than that of the roll support shaft 28 are coaxially and detachably attached to both ends of the roll support shaft 28.

Each of the pair of roll support arms 25 and 25 has a thickness corresponding to the thickness of each bearing 30, and a recessed portion 31 that receives the bearing 30 is formed at an intermediate portion of an upper end surface of each roll support arm 25.

Moreover, a pair of bearing guides 26*a* and 26*b* are provided on both sides of the upper end surface of each roll support arm 25 to project therefrom and extend from a distal end of the roll support arm 25 toward the recessed portion 31.

A core of the roll 27 includes, at both ends thereof, securing rings 29, and attachment of the roll 27 to the roll support shaft 28 is performed by detaching the bearing 30 from one end of the roll support shaft 28, then inserting the roll support shaft 28 into the core of the roll 27 from the side of the one end up to a portion before the bearing 30 at the other end of the roll support shaft 28, then securing the roll 27 to the roll support shaft 28 with the securing rings 29, and then attaching the bearing 30 again to the one end of the roll support shaft.

Also, the bearings 30 and 30 at both ends of the roll support shaft 28 to which the roll 27 is attached are placed on distal ends of the upper end surfaces of the pair of roll support arms 25 and 25, the roll support shaft 28 is caused to roll around on the upper end surfaces of the pair of roll support arms 25 and 25 toward the recessed portions 31 along with the roll 27 with each bearing 30 guided by a related one of the pairs of bearing guides 26*a* and 26*b*, and at the timing at which each bearing 30 is fitted into a related one of the recessed portions 31, loading of the roll 27 on the roll accommodation unit is completed.

Also, in such a continuous sheet processing apparatus, the previous roll 27 is detached from the roll accommodation unit, and a new roll 27 is loaded thereon when the remaining amount of the roll 27 is reduced to a specific amount or when the size, the type, or the like of the continuous sheet is to be changed.

However, since the bearings 30 and 30 with a larger diameter than that of the roll support shaft 28 are attached to both ends of the roll support shaft 28 in this configuration, it is necessary to constantly perform an operation of detaching one bearing 30 out of the two bearings 30 and 30 from the roll support shaft 28 and attaching the bearing 30 again when the roll 27 is attached to the roll support shaft 28 or is detached from the roll support shaft 28.

Therefore, there is a problem that attachment and detachment of the roll to and from the roll support shaft require time and efforts and it thus takes a time to perform an operation of loading a roll on the continuous sheet processing apparatus.

Therefore, an object of the present invention is to enable the operation of loading a roll on a continuous sheet processing apparatus to be easily performed in a short period of time.

BRIEF SUMMARY

In order to solve the aforementioned problem, the present invention provides a roll accommodation unit that accommodates a roll of a continuous sheet such that the roll is rotatable about a horizontal axis, the roll accommodation unit including: a roll support shaft to which the roll is attached; a pair of side walls that are disposed at an interval in a horizontal direction along the horizontal axis; and a pair of roll bearings that are attached to each of the pair of side walls and are disposed at an interval in a width direction of the side walls, in which recessed portions with substantially V shapes along the width direction are formed at upper ends of the pair of side walls, the pairs of rolling bearings are attached to the side walls at positions corresponding to bottoms of the recessed portions such that the rolling bearings project upward beyond inclined surfaces of the recessed portions, the roll support shaft includes a support shaft main body that has a length corresponding to a distance between outer surfaces of the pair of side walls, and a pair of small-diameter portions that are provided at both ends of the support shaft main body and have smaller outer diameters than an outer diameter of the support shaft main body, and the roll support shaft is supported with the small-diameter portions abutting on outer circumferential surfaces of the pairs of rolling bearings in a state in which the support shaft main body is located at an interval from the recessed portions.

According to a preferred embodiment of the present invention, the roll support shaft includes a large-diameter portion that is disposed to be adjacent to one end side of the roll support shaft relative to the small-diameter portions and has a larger outer diameter than the outer diameters of the small-diameter portions.

According to a preferred embodiment of the present invention, a flange portion provided at an interval corresponding to a thickness of the side walls from an end portion of the support shaft main body is formed at the support shaft main body on the one end side of the roll support shaft.

According to a preferred embodiment of the present invention, the roll accommodation unit includes: a bottom wall with a front surface on which the pair of side walls are provided to stand from the bottom wall; and a plurality of casters that are attached to a rear surface of the bottom wall.

In order to solve the aforementioned problem, the present invention provides a processing apparatus including: a roll accommodation unit that accommodates a roll of a continuous sheet such that the roll is rotatable about a horizontal axis; and a main body that pulls out the continuous sheet from the roll accommodation unit and performs processing on the continuous sheet, in which the roll accommodation unit includes a roll support shaft to which the roll is attached, a pair of side walls that are disposed at an interval in a horizontal direction along the horizontal axis, and a pair of rolling bearings that are attached to the pair of side walls and are disposed at an interval in a width direction of the side walls, recessed portions with substantially V shapes along the width direction are formed at upper ends of the pair of side walls, the pairs of rolling bearings are attached to the side walls at positions corresponding to bottoms of the recessed portions such that the rolling bearings project upward beyond inclined surfaces of the recessed portions, the roll support shaft includes a support shaft main body that has a length corresponding to a distance between outer surfaces of the pair of side walls, and a pair of small-diameter portions that are provided at both ends of the support shaft main body and have smaller outer diameters than an outer diameter of the support shaft main body, and the roll support shaft is supported with the small-diameter portions abutting on outer circumferential surfaces of the pairs of rolling bearings in a state in which the support shaft main body is located at an interval from the recessed portions.

According to a preferred embodiment of the present invention, the main body includes a horizontal guide plate that is provided to project from a lower outer surface, and a pair of guide holes that are provided above the guide plate, the roll accommodation unit includes a bottom wall with a front surface on which the pair of side walls are provided to stand from the bottom wall, a plurality of casters that are attached to a rear surface of the bottom wall, a passage that is opened on a lower side of the bottom wall and extends along the bottom wall, a pair of guide rails that extend along the passage at an interval corresponding to a width of the guide plate on both sides of the passage, an auxiliary roller that is attached to a lower surface of the bottom wall at a center portion of an inlet of the passage, a pair of guide pins that are paired with the pair of guide holes, and a stopper that secures the roll accommodation unit at a constant position to prevent the roll accommodation unit from moving, and a height position of a ground contact surface of the auxiliary roller is lower than a height position of the guide plate.

According to a preferred embodiment of the present invention, the processing apparatus includes: a hand lift that is for mounting the roll attached to the roll support shaft on the roll accommodation unit or dismounting the roll from the roll accommodation unit, in which the hand lift includes an arm that is able to support a lower surface of the roll in a laterally placed state and is able to move upward and downward, the arm includes a roll support plate, which is attached to a distal end of the arm, on which the roll in the laterally placed state is placed, a stopper plate, which is provided to stand from the roll support plate on one side and extends in a front-back direction of the roll support plate, on which one end surface of the roll in the laterally placed state abuts, a first rolling prevention plate, which is provided to stand from a front portion of the roll support plate and extends in an inclined manner in a left-right direction of the roll support plate and in a front upward orientation, on which a front portion of a lower surface of the roll in the laterally placed state abuts, and a second rolling prevention plate, which extends in an inclined manner in parallel with the first rolling prevention plate and in a back upward orientation at an interval behind the first rolling prevention plate on the roll support plate, on which a back portion of the lower surface of the roll in the laterally placed state abuts, and a position of the second rolling prevention plate is adjustable in the front-back direction of the roll support plate.

According to a preferred embodiment of the present invention, the pair of side walls are secured to the main body.

In order to solve the aforementioned problem, the present invention provides a roll setting method of a processing apparatus that includes a roll accommodation unit that accommodates a roll of a continuous sheet such that the roll is rotatable about a horizontal axis and a main body that pulls out the continuous sheet from the roll accommodation unit and performs processing on the continuous sheet, the roll setting method including: a separation step of separating the roll accommodation unit attached to the main body from the main body and causing the roll accommodation unit to move; a setting step of setting the roll in the roll accommodation unit separated from the main body in the separation step; and an attachment step of attaching the roll accommodation unit with the roll set in the setting step to the main body.

According to a preferred embodiment of the present invention, in the setting step, the roll is set by either a first setting method in which an operator sets the roll in the roll accommodation unit or a second setting method in which a lift that is able to move the roll upward and downward sets the roll in the roll accommodation unit.

According to the present invention, a bearing for the roll support shaft is not disposed at the roll support shaft but is disposed on a side on which the roll support shaft is received, and a portion with a larger diameter than that of the roll support shaft is not provided on one of both ends of the roll support shaft (the other end side of the support shaft main body; the side on which the flange portion and the large-diameter portion are not included).

Also, in a case in which the roll is attached to the roll support shaft, the roll support shaft is inserted into a core of the roll from the other end side of the support shaft main body, and the roll is then secured to the roll support shaft.

On the other hand, in a case in which the roll is detached from the roll support shaft, securing of the roll to the roll support shaft is released, and the roll support shaft is then pulled out from the core of the roll.

It is thus possible to significantly easily attach and detach the roll to and from the roll support shaft in a short period of time.

Moreover, according to the present invention, the roll support shaft is first bridged over regions behind the recessed portions at a pair of support walls when the roll support shaft with the roll attached thereto is set at the pair of support walls of the roll accommodation unit. At this time, one end (a portion outside the flange portion) of the support shaft main body and the other end of the support shaft main body come into contact with upper ends of the support walls.

Then, the roll support shaft is caused to roll around toward the recessed portions along with the roll. If the roll support shaft and the roll reach the recessed portions, then the roll support shaft and the roll down along the inclined surfaces of the recessed portions due to their own weight, run on to a portion between the pairs of rolling bearings at the small-diameter portions at both ends of the roll support shaft, and then stop.

In this manner, the roll is set at the pair of support walls.

Also, at this time, a state in which a related pair of rolling bearings are pinched between the support shaft main body and the large-diameter portion on the one end side of the roll support shaft is brought about, and the roll support shaft does not deviate in an axial direction.

It is thus possible to significantly easily perform an operation of loading the continuous sheet in the roll on the processing apparatus in a short period of time.

Further, in a case in which the roll accommodation unit is configured with the roll support shaft and the carriage, it is possible to separate the roll accommodation unit from the continuous sheet processing apparatus (main body) as a unit that is independent from the continuous sheet processing apparatus (main body).

Also, when the roll is loaded on the continuous sheet processing apparatus, it is only necessary for the operator to separate the carriage from the continuous sheet processing apparatus (main body), cause the carriage to move to a roll storage location, set a roll attached to the roll support shaft in the carriage at the location, then cause the carriage to move to the continuous sheet processing apparatus (main body), and attach the carriage to the continuous sheet processing apparatus (main body) again.

Also, when the roll is replaced, it is only necessary for the operator to separate the carriage from the continuous sheet processing apparatus (main body), cause the carriage to a roll storage location, dismount the roll support shaft with the previous roll attached thereto from the carriage at the location, detach the previous roll from the roll support shaft, attach a new roll to the roll support shaft, set a support shaft with the new roll attached thereto in the carriage, then cause the carriage to move to the continuous sheet processing apparatus (main body), and attach the carriage to the continuous sheet processing apparatus (main body) again.

Since it is possible to easily attach and detach the roll accommodation unit to and from the continuous sheet processing apparatus (main body) and to quickly cause the roll accommodation unit to move, the operation of loading the roll on the roll accommodation unit can be performed at a location where there is an enough working space separated from the continuous sheet processing apparatus (main body), and it is thus possible to more easily perform the operation of loading the roll on the continuous sheet processing apparatus in a short period of time.

BRIEF DESCRIPTION OF THE SEVERAL VIEWS OF THE DRAWINGS

FIG. 1A is a perspective view illustrating a state in which a roll support shaft has been set in a carriage, and FIG. 1B is a perspective view of the roll support shaft;

FIG. 6A is a perspective view of an arm of the hand lift, FIG. 6B is an enlarged perspective view of a distal end portion of the arm, and FIG. 6C is a diagram similar to FIG. 6A, which illustrates a state in which a roll is supported at the arm;

DETAILED DESCRIPTION

Hereinafter, a configuration of the present invention will be described on the basis of preferred embodiments with reference to the accompanying drawings.

Figure 1A:
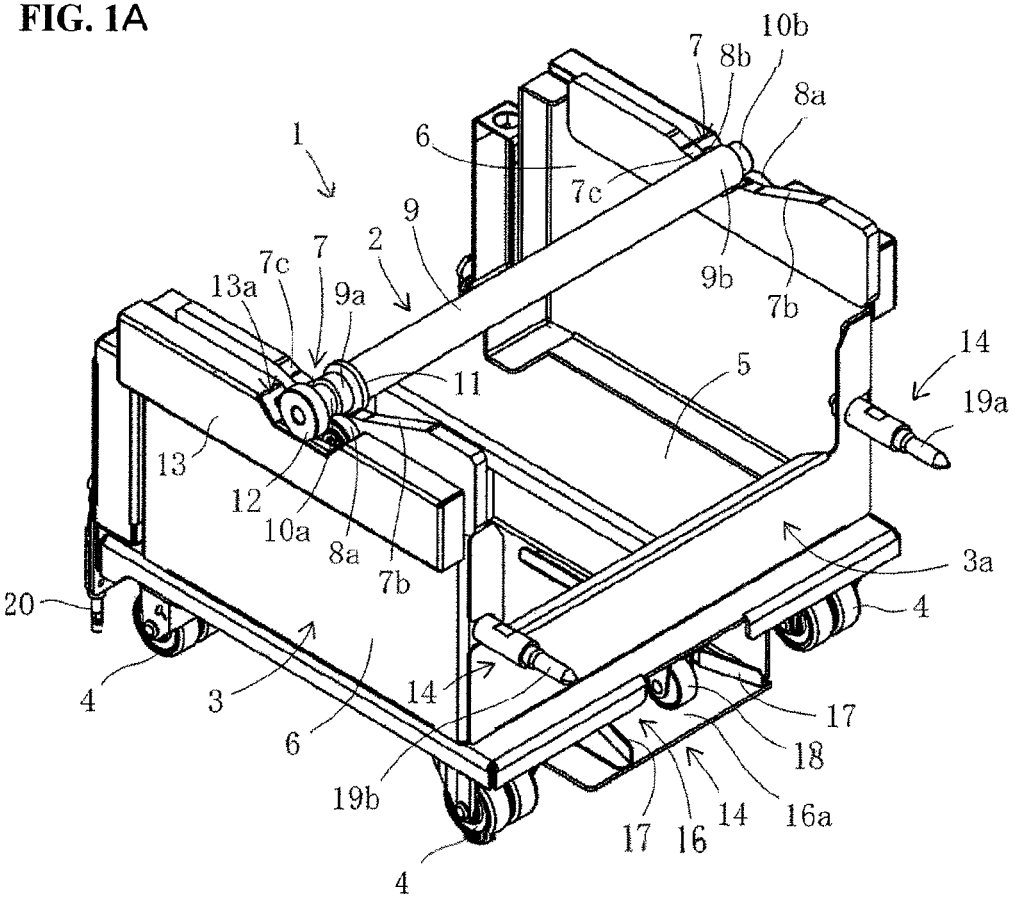
FIGS. 1A-1B show a diagram illustrating a roll accommodation unit of a continuous sheet processing apparatus according to an embodiment of the present invention, where
Figure 1B:
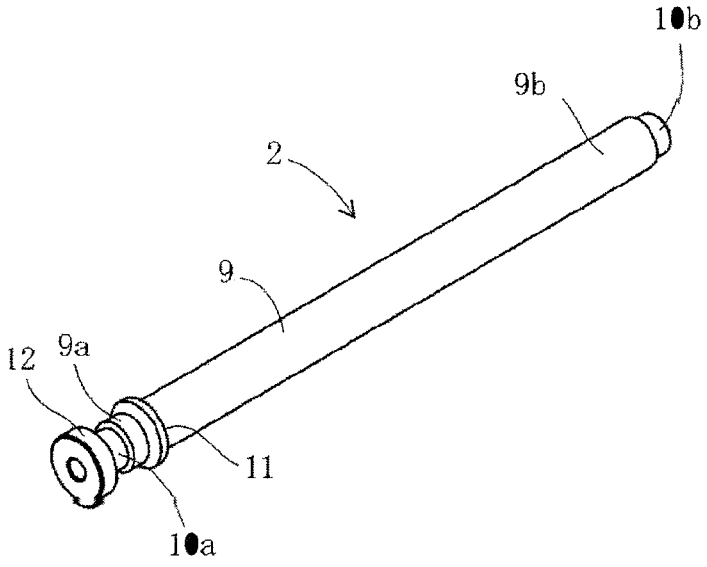
Figure 2A:
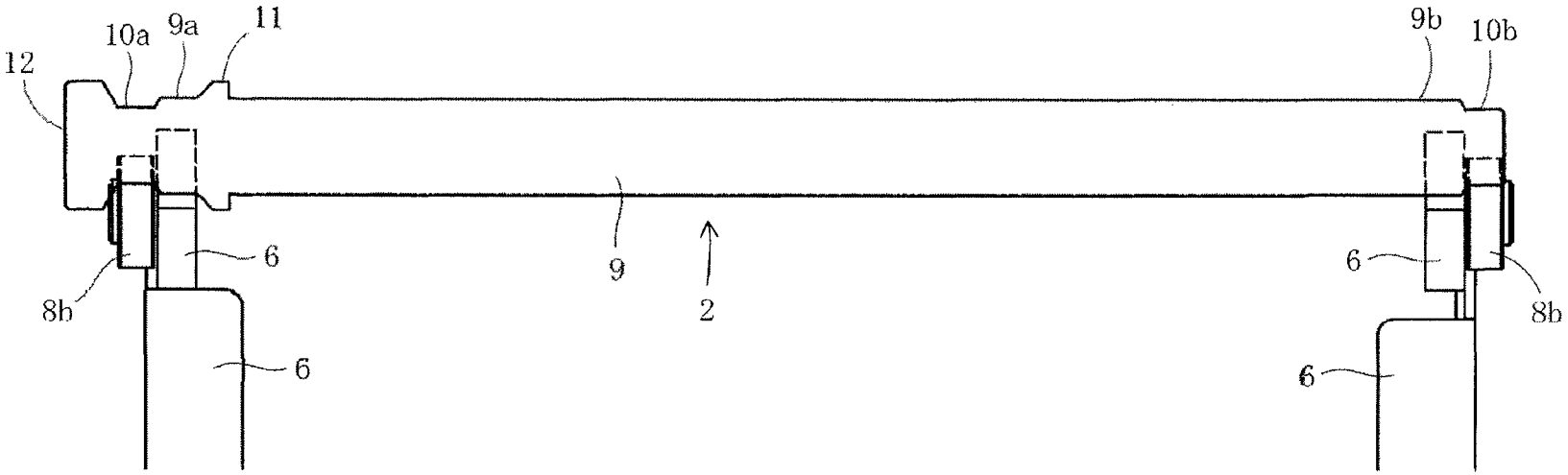
FIG. 2A is an enlarged sectional view along the roll support shaft in FIG. 1A.
Figure 2B:
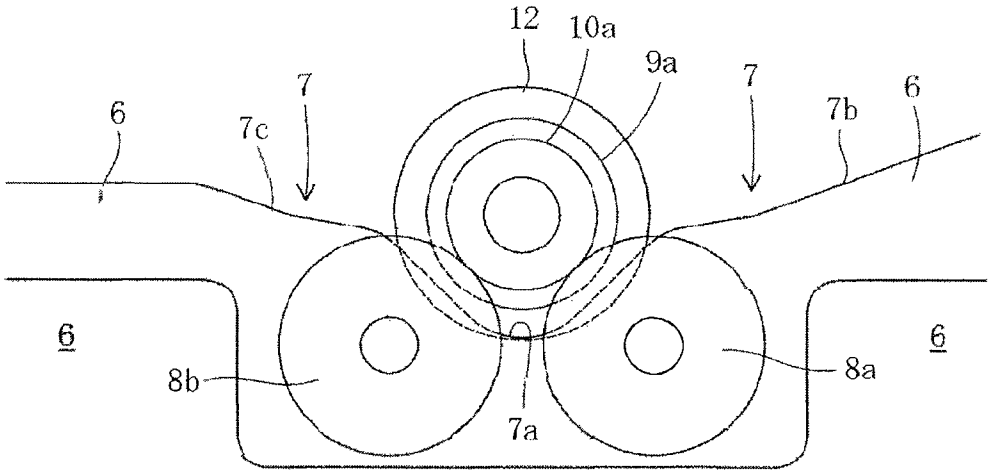
FIG. 2B is an enlarged side view of the roll support shaft and a pair of rolling bearings of the carriage in FIG. 1A.

FIGS. 1A-1B show a diagram illustrating a roll accommodation unit of a continuous sheet processing apparatus according to an embodiment of the present invention, where FIG. 1A is a perspective view illustrating a state in which a roll support shaft has been set in a carriage, and FIG. 1B is a perspective view of the roll support shaft. Also, FIG. 2A is an enlarged sectional view along the roll support shaft in FIG. 1A, and FIG. 2B is an enlarged side view of a pair of roll bearings of the carriage and the roll support shaft in FIG. 1A.

Referring to FIGS. 1A-1B and 2A-2B, the continuous sheet processing apparatus according to the present invention includes a roll accommodation unit 1 that accommodates a roll R of a continuous sheet such that the roll R is rotatable about a horizontal axis, and in this embodiment, the roll accommodation unit 1 includes a roll support shaft 2 to which the roll R of the continuous sheet is attached and a carriage 3 that horizontally supports the roll support shaft 2 with the roll R attached thereto such that the roll support shaft 2 is rotatable about an axis and is detachably attached to a main body of the continuous sheet processing apparatus.

The carriage 3 includes a bottom wall 5 with a rear surface to which casters 4 are attached at four corners and a pair of side walls 6 and 6 that are provided to stand from a front surface of the bottom wall 5. The pair of side walls 6 and 6 are disposed in parallel at an interval in a horizontal direction along the horizontal axis.

Also, recessed portions 7 with substantially V shapes when seen in a direction of perpendicularly crossing the pair of side walls 6 and 6 (the left-right direction of the carriage 3) are formed at upper end center portions of the pair of side walls 6 and 6. The recessed portions 7 are formed to have substantially V shapes along the width direction of the side walls 6 (the front-back direction of the carriage 3).

The carriage 3 further includes a pair of rolling bearings 8*a* and 8*b* that are attached to a position corresponding to a bottom 7*a* of the recessed portion 7 in the outer surface of each of the pair of side walls 6 and 6 such that the rolling bearings 8*a* and 8*b* face each other in the front-back direction of the carriage 3 (the width direction of the V shape) and each of the rolling bearings 8*a* and 8*b* is rotatable about the horizontal axis. The pair of rolling bearings 8*a* and 8*b* are disposed at an interval in the width direction of the pair of side walls 6 and 6 (the front-back direction of the carriage 3).

As illustrated in FIG. 2B, a clearance between the pair of rolling bearings 8*a* and 8*b* conforms to the bottom 7*a* of the related recessed portion 7, the rolling bearing 8*a* on the front side out of the pair of rolling bearings 8*a* and 8*b* projects upward beyond an inclined surface 7*b* on the front side of the related recessed portion 7, and the rolling bearing 8*b* on the rear side out of the pair of rolling bearings 8*a* and 8*b* projects upward beyond an inclined surface 7*c* on the rear side of the related recessed portion 7. In other words, the pairs of rolling bearings 8*a* and 8*b* are attached to the side walls 6 at the positions corresponding to the bottoms 7*a* of the recessed portions 7 such that the rolling bearings 8*a* and 8*b* project upward beyond the inclined surfaces of the recessed portions 7.

The roll support shaft 2 includes a support shaft main body 9 that has a constant diameter and has a length corresponding to the distance between outer surfaces of the pair of side walls 6 and 6 of the carriage 3, small-diameter portions 10*a* and 10*b* that extend by a length corresponding to the thickness of the rolling bearings 8*a* and 8*b* concentrically from both ends of the support shaft main body 9, a flange portion 11 that is provided at an interval corresponding to the thickness of the side walls 6 from one end 9*a* of the support shaft main body 9 on the side of the other end 9*b*, and a large-diameter portion 12 that is concentrically adjacent to the small-diameter portion 10*a* on the side of the one end 9*a* of the support shaft main body 9. As illustrated in FIG. 2A, the outer diameters of the small-diameter portions 10*a* and 10*b* are smaller than the outer diameter of the support shaft main body 9. Also, the large-diameter portion 12 is disposed to be adjacent to the roll support shaft 2 on the one end side relative to the small-diameter portion 10*a* and has a larger outer diameter than that of the small-diameter portion 10*a*.

The roll support shaft 2 can be supported between the pair of side walls 6 and 6 of the carriage 3 in a state in which the small-diameter portions 10*a* and 10*b* at both ends abut on the outer circumferential surfaces of the pairs of rolling bearings 8*a* and 8*b*, and the support shaft main body 9 is located at an interval from the recessed portions 7.

In the illustrated embodiment, a cover 13 that protects the pair of rolling bearings 8*a* and 8*b* is attached to an outer surface upper portion of each side wall 6 and extends in the front-back direction of the carriage 3, an opening 13*a* is provided at a position in the upper portion of the cover 13 corresponding to the pair of rolling bearings 8*a* and 8*b*, and the pair of rolling bearings 8*a* and 8*b* are exposed from the opening 13*a*.

Note that the cover 13 does not come into contact with the roll support shaft 2 that is bridged over the pair of side walls 6 and 6, and rolls.

Figure 3:
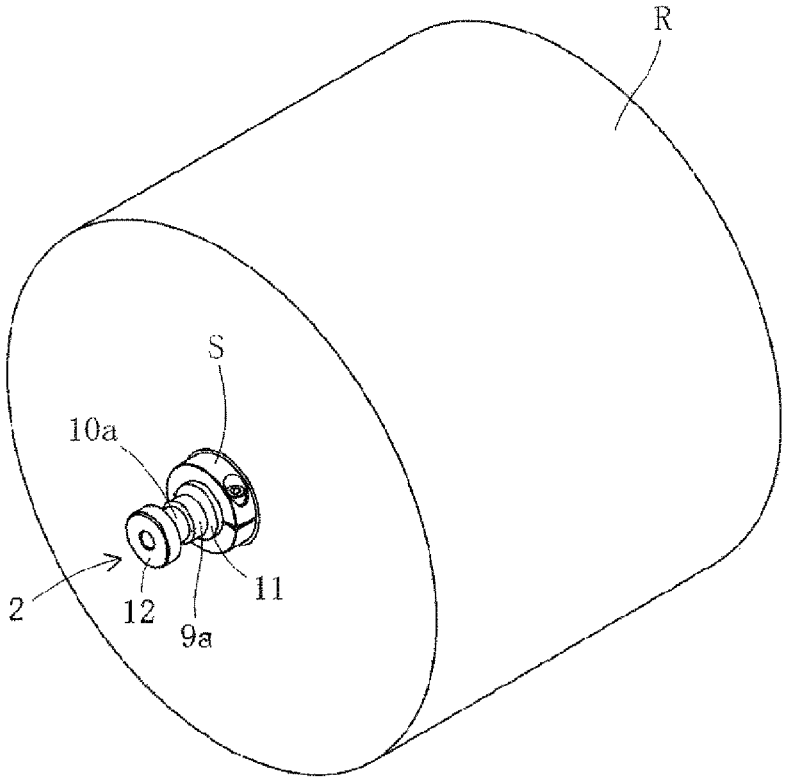
FIG. 3 is a perspective view illustrating a state in which a roll has been attached to the roll support shaft in FIGS. 1A-1B.

FIG. 3 is a perspective view illustrating a state in which the roll R has been attached to the roll support shaft 2.

Referring to FIG. 3, the roll R is attached to the roll support shaft 2 by the roll R being pinched between a pair of securing rings S that can be secured to the roll support shaft 2 in this embodiment.

In other words, one of the securing rings S out of the pair of the securing rings S is fitted onto the roll support shaft 2 from the side of the other end 9*b* of the support shaft main body 9 and is secured at a predetermined position on the roll support shaft 2 in advance. Then, the roll support shaft 2 is inserted into the core of the roll R from the side of the other end 9*b* of the support shaft main body 9 until the one of the securing rings S abuts on the end surface of the roll R, and the other securing ring S out of the pair of securing rings S is then fitted onto the roll support shaft 2 from the side of the other end 9*b* of the support shaft main body 9 until the other securing ring S abuts on the end surface of the roll R and is secured to the roll support shaft 2.

Also, detachment of the roll R from the roll support shaft 2 is performed by detaching the other securing ring S from the roll support shaft 2 and then pulling out the roll support shaft 2 from the roll R.

Note that a mean for securing the roll R to the roll support shaft 2 is not limited to that in the embodiment, and an appropriate, known configuration may be included. For example, the roll R may be secured to the roll support shaft 2 by pinching the roll R between the flange portion 11 of the roll support shaft 2 and an appropriate securing tool that can be secured to the roll support shaft 2 or the roll R may be provided with a securing means.

It is thus possible to significantly easily perform attachment and detachment of the roll R to and from the roll support shaft 2 in a short period of time.

When the roll support shaft 2 with the roll R attached thereto is set in the carriage 3, the roll support shaft 2 is first bridged over regions behind the recessed portions 7 in the pair of side walls 6 and 6 of the carriage 3. At this time, the one end 9*a* (a portion outside the flange portion 11) and the other end 9*b* of the support shaft main body 9 come into contact with upper ends of the side walls 6.

Then, the roll support shaft 2 is caused to roll around toward the recessed portion 7 along with the roll R. If the roll support shaft 2 and the roll R reach the recessed portions 7, then the roll support shaft 2 and the roll R roll down along the inclined surfaces 7*c* on the rear side of the recessed portions 7 due to their own weights, run on to a portion between the pairs of rolling bearings 8*a* and 8*b* at the small-diameter portions 10*a* and 10*b* at both ends of the roll support shaft 2, and stop.

In this manner, the roll R is set in a state in which the roll R is positioned relative to the carriage 3 in the front-back direction of the carriage 3.

Also, at this time, a state in which the pair of rolling bearings 8*a* and 8*b* is pinched between the support shaft main body 9 and the large-diameter portion 12 is brought about on the side of one end of the roll support shaft 2 (the one end 9*a* of the support shaft main body 9), and the roll support shaft 2 is prevented from being deviated in the axial direction.

In this manner, the roll R is set in a state in which the roll R is positioned relative to the carriage 3 in the left-right direction of the carriage 3.

In this manner, it is possible to significantly easily set the roll R in the carriage 3 in a short period of time.

The carriage 3 further includes a coupling portion 14 for detachable coupling to the main body of the continuous sheet processing apparatus.

Figure 4:
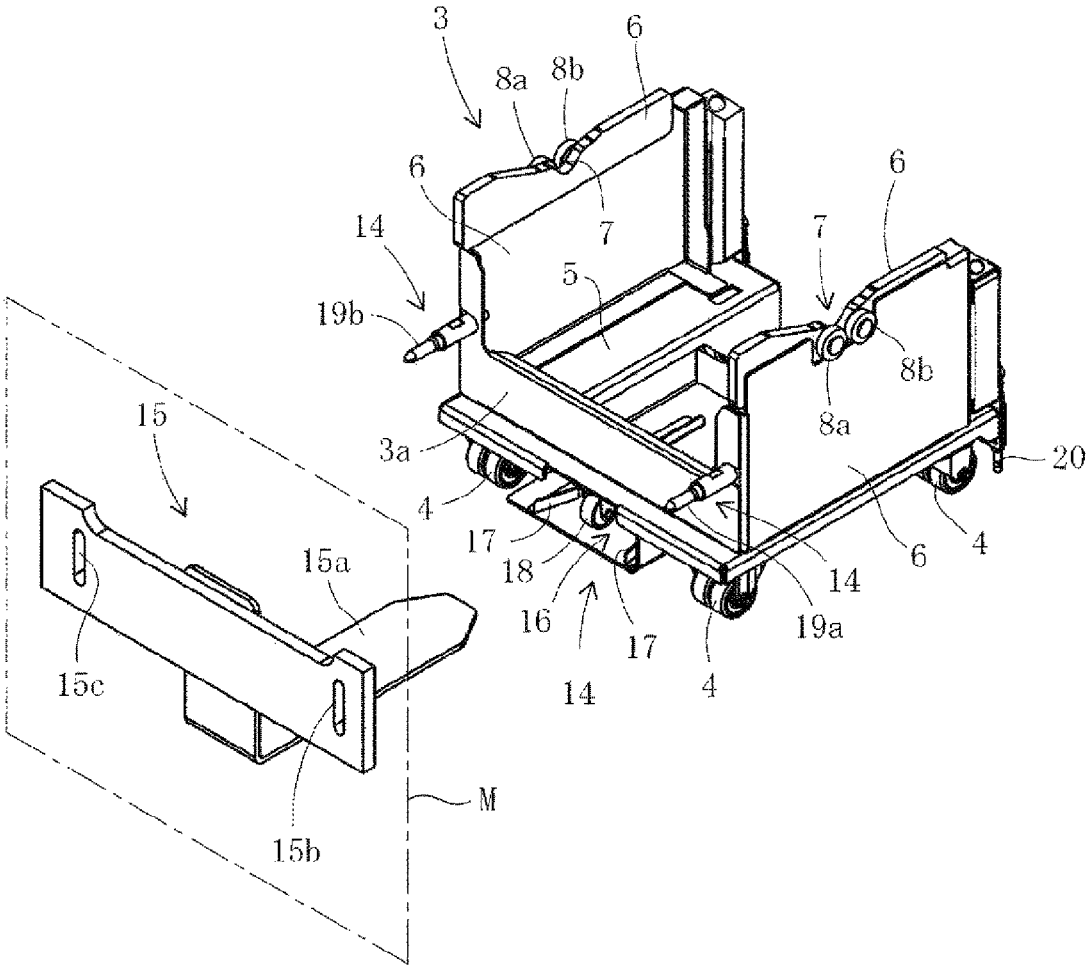
FIG. 4 is a perspective view illustrating configurations of a coupling portion of the carriage in FIG. 1A and a carriage attachment portion of a main body of the continuous sheet processing apparatus corresponding to the coupling portion.

FIG. 4 is a perspective view illustrating configurations of a coupling portion of the carriage and a carriage attachment portion of the continuous sheet processing apparatus corresponding to the coupling portion.

Referring to FIG. 4, a main body M of the continuous sheet processing apparatus is provided with a carriage attachment portion 15, and the carriage attachment portion 15 includes a horizontal guide plate 15*a* provided to project from a lower outer surface of the main body M and a pair of guide holes 15*b* and 15*c* provided above the guide plate 15*a* on the lower outer surface of the main body M and on both sides of the guide plate 15*a*.

The coupling portion 14 of the carriage 3 includes a passage 16 that is opened on the lower side of the bottom wall 5 at a front end 3*a* of the carriage 3 and extends backward along the bottom wall 5 from the front end 3*a* and a pair of guide rails 17 and 17 that are provided to project from both sides of an inner wall bottom surface 16*a* of the passage 16 at an interval corresponding to the width of the guide plate 15*a* of the carriage attachment portion 15.

The coupling portion 14 further includes an auxiliary roller 18 that is attached to the lower surface of the bottom wall 5 of the carriage 3 at the center portion of the inlet of the passage 16 and is rotatable about an axis extending in the left-right direction of the carriage 3.

The height position of a ground contact surface of the auxiliary roller 18 is lower than the height position of the guide plate 15*a* of the carriage attachment portion 15.

The coupling portion 14 further includes a pair of guide pins 19*a* and 19*b* that are provided on both sides of the front end 3*a* of the carriage 3, project forward from the front end 3*a*, and are paired with the pair of guide holes 15*b* and 15*c* of the carriage attachment portion 15 and a stopper 20 that secures the carriage 3 at a constant position to prevent the carriage 3 from moving.

The stopper 20 includes an operating rod that is attached to the rear end of the carriage 3, projects downward from the carriage 3, and can move upward and downward between a stopping position at which the distal end comes into pressure contact with a floor surface and a stopping released position at which the distal end draws back on the side of the carriage 3.

Although not illustrated, a handle can be detachably attached to the rear end of the carriage 3.

Figure 5A:
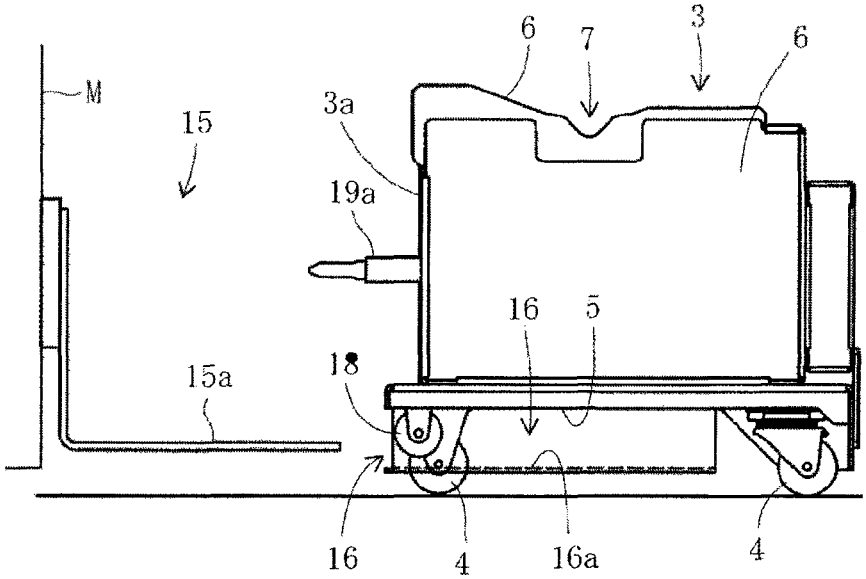
FIGS. 5A-5B show a side sectional view for explaining a method for attaching the carriage of the roll accommodation unit in FIG. 1A to the main body of the continuous sheet processing apparatus.
Figure 5B:
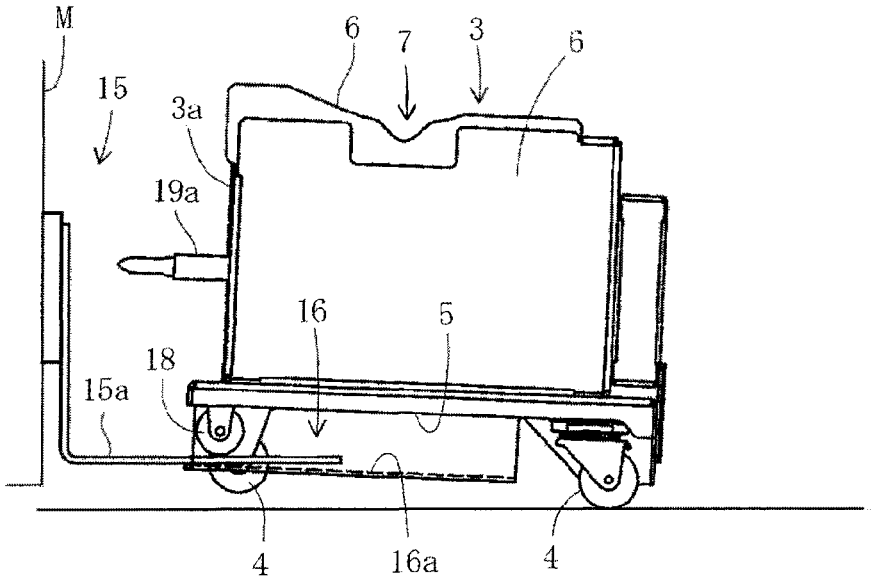

FIGS. 5A-5B show a side sectional view for explaining a method of attaching the carriage of the roll accommodation unit in FIGS. 1A-1B to the main body of the continuous sheet processing apparatus.

Referring to FIG. 5A, in a case in which the carriage 3 with the roll support shaft 2 and the roll R set therein is attached to the main body M of the continuous sheet processing apparatus, the carriage 3 is caused to advance forward toward the carriage attachment portion 15 in an arrangement in which the inlet of the passage 16 of the carriage 3 conforms to the guide plate 15*a* of the carriage attachment portion 15 of the main body M of the continuous sheet processing apparatus and the pair of guide pins 19*a* and 19*b* of the carriage 3 conform to the pair of guide holes 15*b* and 15*c* of the carriage attachment portion 15.

During the motion of advancing forward, the guide plate 15*a* of the carriage attachment portion 15 is guided by the pair of guide rails 17 and 17 of the carriage 3 and is then inserted into the passage 16, and the auxiliary roller 18 of the carriage 3 runs on to the guide plate 15*a* (see FIG. 5B). At this time, the carriage 3 is supported at three points, namely the pair of casters 4 on the rear side and the auxiliary roller 18.

At the same time, the pair of guide pins 19*a* and 19*b* of the carriage 3 are inserted into the guide holes 15*b* and 15*c* of the carriage attachment portion 15.

Then, the stopper 20 of the carriage 3 is caused to move from the stopping released position to the stopping position, and the carriage 3 is secured at the constant position to prevent the carriage 3 from moving.

In this manner, the carriage 3 is attached to the main body M of the continuous sheet processing apparatus in a state in which the carriage 3 is positioned relative to the main body M of the continuous sheet processing apparatus.

According to the present invention, it is possible to separate the roll accommodation unit 1 from the main body M of the continuous sheet processing apparatus as a unit that is independent from the main body M of the continuous sheet processing apparatus.

Also, when the roll is loaded on the continuous sheet processing apparatus, it is only necessary for the operator to separate the carriage 3 from the main body M of the continuous sheet processing apparatus, cause the carriage 3 to move to a roll storage location (separation step), set the roll R attached to the roll support shaft 2 in the carriage 3 at the location (setting step), then cause the carriage 3 to move to the main body M of the continuous sheet processing apparatus, and attach the carriage 3 to the main body M of the continuous sheet processing apparatus again (attachment step).

Also, when the roll is replaced, it is only necessary for the operator to separate the carriage 3 from the main body M of the continuous sheet processing apparatus, cause the carriage 3 to move to the roll storage location (separation step), dismount the roll support shaft 2 with the previous roll R attached thereto from the carriage 3 at the location, detach the previous roll R from the roll support shaft 2, attach a new roll R to the roll support shaft 2, set the roll support shaft 2 with the new roll R attached thereto in the carriage 3 (setting step), cause the carriage 3 to move to the main body M of the continuous sheet processing apparatus, and attach the carriage 3 to the main body M of the continuous sheet processing apparatus again (attachment step).

In this manner, it is possible to easily attach and detach the roll accommodation unit 1 to and from the main body M of the continuous sheet processing apparatus, to quickly cause the roll accommodation unit 1 to move, thereby to perform the operation of loading the roll R on the roll accommodation unit 1 at a location with an enough working space separated from the main body M of the continuous sheet processing apparatus, and thus to easily perform the operation of loading the roll R on the continuous sheet processing apparatus in a short period of time.

According to another preferred embodiment of the present invention, the continuous sheet processing apparatus according to the present invention further includes a hand lift 21 for mounting the roll R inserted into the roll support shaft 2 on the carriage 3 or dismounting the roll R from the carriage 3.

Figure 6A:
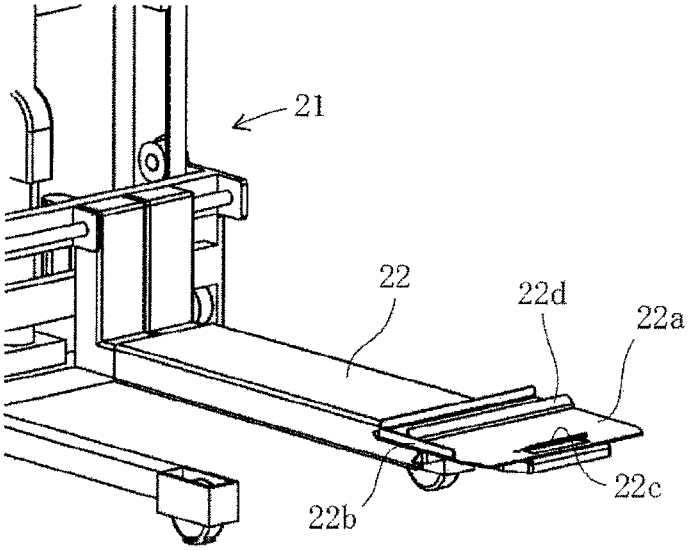
FIGS. 6A-6C show a diagram illustrating a hand lift of the continuous sheet processing apparatus according to another embodiment of the present invention, where
Figure 6B:
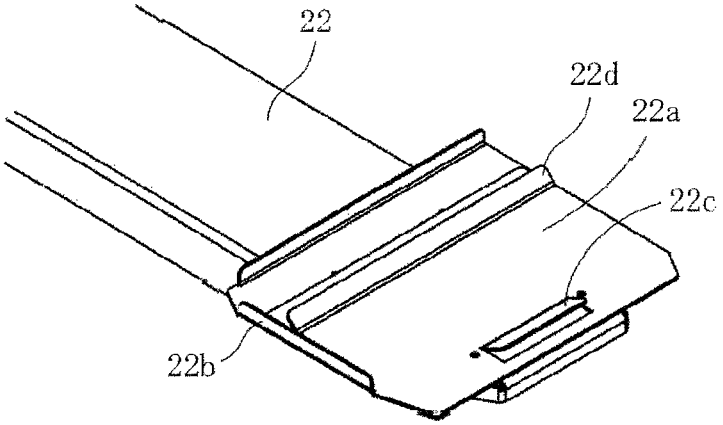
Figure 6C:
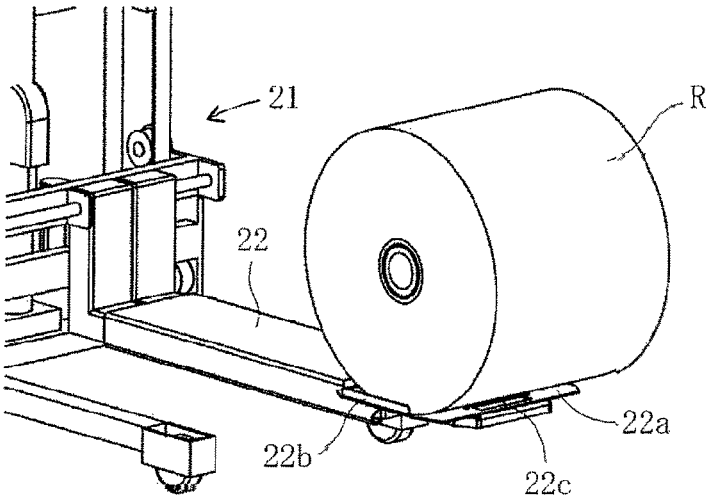

A configuration of the hand lift 21 is illustrated in FIGS. 6A-6C. FIG. 6A is a perspective view of an arm of the hand lift, FIG. 6B is an enlarged perspective view of a distal end portion of the arm, and FIG. 6C is a diagram similar to FIG. 6A, which illustrates a state in which the roll is supported at the arm.

As illustrated in FIGS. 6A-6C, the hand lift 21 includes an arm 22 that can support the lower surface of the roll R in a laterally placed state and can move upward and downward.

The arm 22 includes a roll support plate 22*a*, which is attached to the distal end of the arm 22, on which the roll R in the laterally placed state is placed, and a stopper plate 22*b*, which is provided to stand on one side of the roll support plate 22*a* and extends in the front-back direction of the roll support plate 22*a*, on which one end surface of the roll R in the laterally placed state abuts.

The arm 22 further includes a first rolling prevention plate 22*c*, which is provided to stand from a front portion of the roll support plate 22*a* and extends in an inclined manner in the left-right direction of the roll support plate 22*a* and in a front upward orientation, on which the front portion of the lower surface of the roll R in the laterally placed state abuts, and a second rolling prevention plate 22*d*, which extends in an inclined manner in parallel with the first rolling prevention plate 22*c* at an interval behind the first rolling prevention plate 22*c* on the roll support plate 22*a* and in a back upward orientation, on which the rear portion of the lower surface of the roll R in the laterally placed state abuts.

The second rolling prevention plate 22*d* is attached to the roll support plate 22*a* using a magnetic force, for example, and the position thereof is adjustable in the front-back direction of the roll support plate 22*a*.

FIGS. 7A-7D is a perspective view for explaining a method of using the hand lift in FIGS. 6A-6C.

Figure 7A:
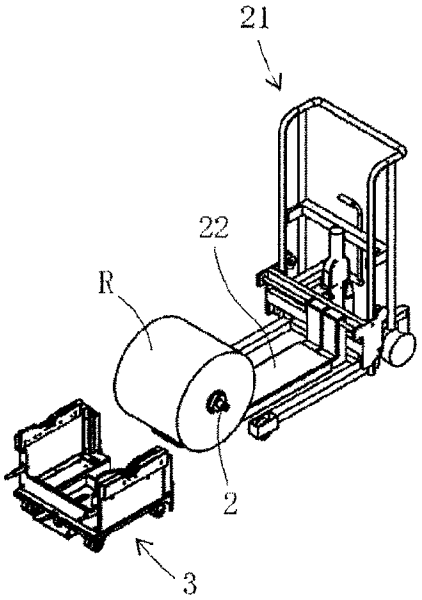
FIGS. 7A-7D show a perspective view for explaining a method of using the hand lift in FIGS. 6A-6C.
Figure 7B:
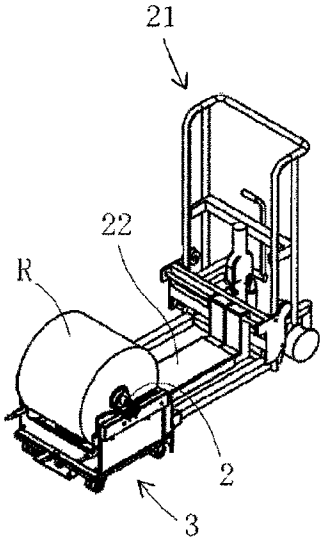

As illustrated in FIG. 7A, the roll R in a state in which the roll R is attached to the roll support shaft 2 is placed on the roll support plate 22*a* of the arm 22 of the hand lift 21, and the arm 22 then moves upward up to a position that is higher than the pair of side walls of the carriage 3. Then, the hand lift 21 approaches the carriage 3 from the rear side, and the arm 22 enters a portion between the pair of side walls from the rear end of the carriage 3. The hand lift 21 stops at a timing at which the roll support shaft 2 reaches the clearance between the pair of rolling bearings of the carriage 3 (see FIG. 7B).

Figure 7C:
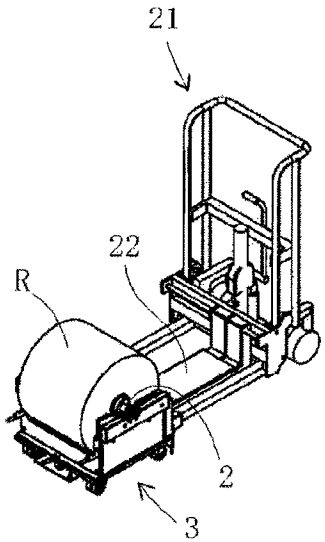
Figure 7D:
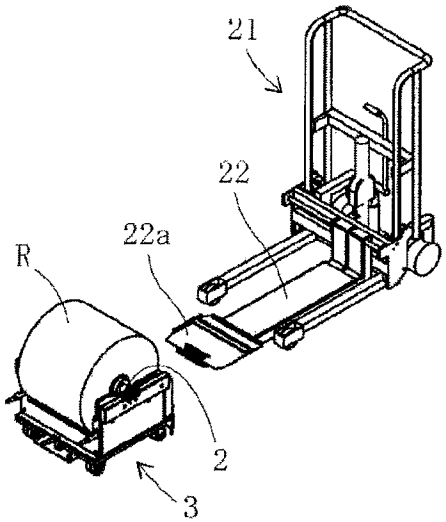

Then, the arm 22 moves downward, and both ends of the roll support shaft 2 (roll R) are placed on the pair of side walls (each of the pairs of rolling bearings) of the carriage 3 (see FIG. 7C). Thereafter, the hand lift 21 is separated on the rear side of the carriage 3, and the mounting of the roll R on the carriage 3 is completed.

It is possible to efficiently perform the operation of mounting the roll R on the carriage 3 or dismounting the roll R from the carriage 3 by including the hand lift 21, and further, a burden on the operator is reduced.

Figure 8:
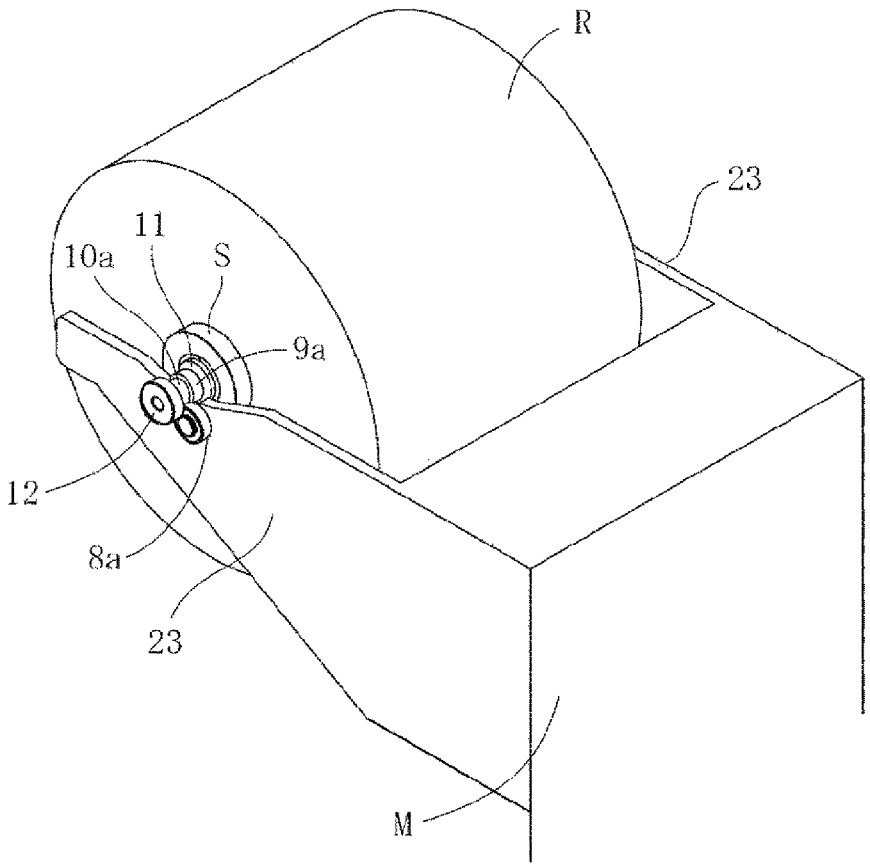
FIG. 8 is a perspective view of a roll accommodation unit of a continuous sheet processing apparatus according to another embodiment of the present invention.
Figure 9:
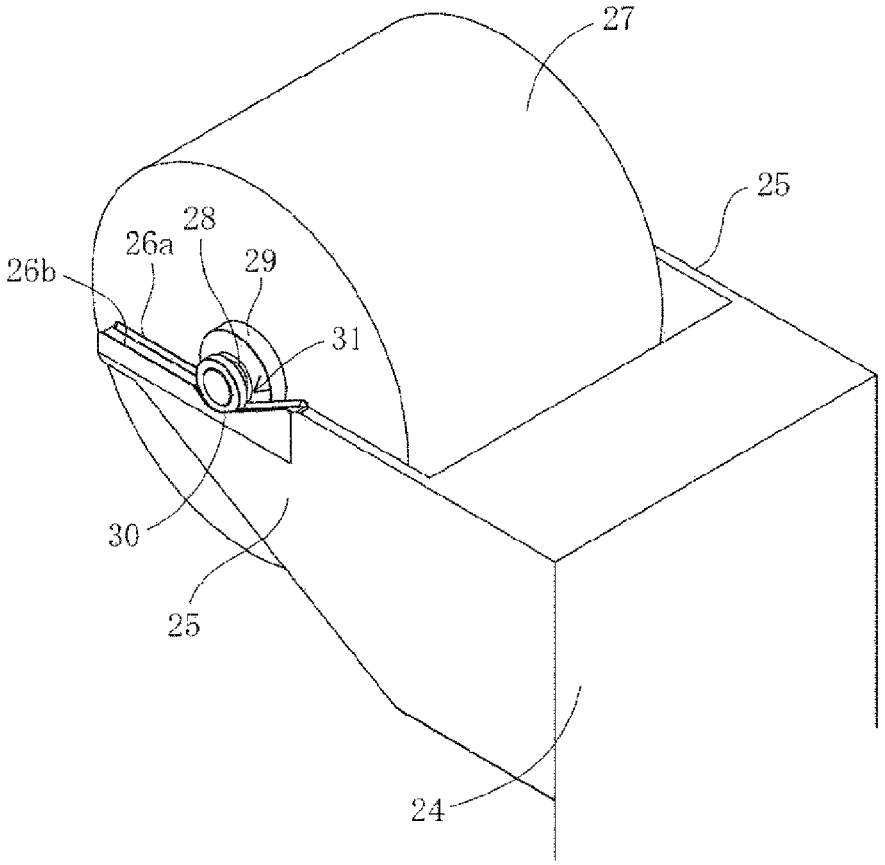
FIG. 9 is a perspective view illustrating an example of a roll accommodation unit of a continuous sheet processing apparatus in the related art.

FIG. 8 is a perspective view of a roll accommodation unit of a continuous sheet processing apparatus according to another embodiment of the present invention.

The embodiment in FIG. 8 is different only in that a roll support shaft is set in a structure secured to the continuous sheet processing apparatus while the roll support shaft is set in a movable object (carriage) that can be separated from the continuous sheet processing apparatus in the embodiment in FIGS. 1A-1B. Therefore, the same numbers will be applied to the same components in FIG. 8 as those in FIGS. 1A-1B, and detailed description thereof will be omitted below.

Referring to FIG. 8, a roll accommodation unit 1 includes a roll support shaft 2 (with the same configuration as that in the example in FIG. 1) to which a roll R is attached and a pair of roll support arms 23 and 23 that are secured to a main body M of the continuous sheet processing apparatus in this embodiment.

Also, each of upper portions of the pair of roll support arms 23 and 23 has the same configuration as that of the upper portions of the pair of side walls 6 and 6 of the carriage 3 in the embodiment in FIGS. 1A-1B.

Even in this embodiment, it is possible to perform the attachment of the roll R to the roll support shaft 2 similarly to the case of the embodiment in FIGS. 1A-1B and further to set the roll support shaft 2 with the roll R attached thereto at the pair of roll support arms 23 and 23 similarly to the case in which the roll support shaft 2 with the roll R attached thereto is set in the carriage 3 in the embodiment in FIGS. 1A-1B.

Although the configuration of the present invention has been described above on the basis of the preferred embodiments, it is a matter of course that the configuration of the present invention is not limited to the aforementioned embodiments and those skilled in the art can contrive various modifications within the scope defined by the accompanying claims.

What is claimed is:

1. A roll accommodation unit that accommodates a roll of a continuous sheet such that the roll is rotatable about a horizontal axis, the roll accommodation unit comprising:

a roll support shaft to which the roll is attached;

a pair of side walls that are disposed at an interval in a horizontal direction along the horizontal axis; and a pair of roll bearings that are attached to each of the pair of side walls and are disposed at an interval in a width direction of the side walls, wherein recessed portions with substantially V shapes along the width direction are formed at upper ends of the pair of side walls, the pairs of rolling bearings are attached to the side walls at positions corresponding to bottoms of the recessed portions such that the roiling bearings project upward beyond inclined surfaces of the recessed portions, the roll support shaft includes a support shaft main body that has a length corresponding to a distance between outer surfaces of the pair of side walls, and a pair of small-diameter portions that are provided at both ends of the support shaft main body and have smaller outer diameters than an outer diameter of the support shaft main body, and the roll support shaft is supported with the small-diameter portions abutting on outer circumferential surfaces of the pairs of rolling bearings in a state in which the support shaft main body is located at an interval from the recessed portions.

2. The roll accommodation unit according to claim 1, wherein the roll support shaft includes a large-diameter portion that is disposed to be adjacent to one end side of the roll support shaft relative to the small-diameter portions and has a larger outer diameter than the outer diameters of the small-diameter portions.

3. The roll accommodation unit according to claim 2, wherein a flange portion, provided at an interval corresponding to a thickness of the side walls from an end portion of the support shaft main body is formed, at the support shaft main body on the one end side of the roll support shaft.

4. The roll accommodation unit according to claim 1, comprising:

a bottom wall with a front surface on which the pair of side walls are provided to stand from the bottom wall; and a plurality of casters that are attached to a rear surface of the bottom wall.

5. A processing apparatus comprising:

a roll accommodation unit that accommodates a roll of a continuous sheet such that the roll is rotatable about a horizontal axis; and a main body that pulls out the continuous sheet from the roll accommodation unit and performs processing on the continuous sheet, wherein the roll accommodation unit includes a roll support shaft to which the roll is attached, a pair of side walls that are disposed at an interval in a horizontal direction along the horizontal axis, and a pair of rolling bearings that are attached to each of the pair of side walls and are disposed at an interval in a width direction of the side walls, recessed portions with substantially V shapes along the width direction are formed at upper ends of the pair of side walls, the pairs of rolling bearings are attached to each of the side walls at positions corresponding to bottoms of the recessed portions such that the rolling bearings project upward beyond inclined surfaces of the recessed portions, the roll support shaft includes a support shaft main body that has a length corresponding to a distance between outer surfaces of the pair of side walls, and a pair of small-diameter portions that are provided at both ends of the support shaft main body and have smaller outer diameters than an outer diameter of the support shaft main body, and the roll support shaft is supported with the small-diameter portions abutting on outer circumferential surfaces of the pairs of rolling bearings in a state in which the support shaft main body is located at an interval from the recessed portions.

6. The processing apparatus according to claim 5, wherein the main body includes a horizontal guide plate that is provided to project from a lower outer surface, and a pair of guide holes that are provided above the horizontal guide plate, the roll accommodation unit includes a bottom wall with a front surface on which the pair of side walls are provided to stand from the bottom wall, a plurality of casters that are attached to a lower surface of the bottom wall, a passage that is opened on a lower side of the bottom wall and extends along the bottom wall, a pair of guide rails that extend along the passage at an interval corresponding to a width of the horizontal guide plate on both sides of the passage, an auxiliary roller that is attached to the lower surface of the bottom wall at a center portion of an inlet of the passage, a pair of guide pins that are paired with the pair of guide holes, and a stopper that secures the roll accommodation unit at a constant position to prevent the roll accommodation unit from moving, and a height position of a ground contact surface of the auxiliary roller is lower than a height position of the horizontal guide plate.

7. The processing apparatus according to claim 5, comprising:

a hand lift that is for mounting the roll attached to the roll support shaft on the roll accommodation unit or dismounting the roll from the roll accommodation unit, wherein the hand lift includes an arm that is able to support a lower surface of the roll in a laterally placed state and is able to move upward and downward, the arm includes a roll support plate, which is attached to a distal end of the arm, on which the roll in the laterally placed state is placed, a stopper plate, which is provided to stand from the roll support plate on one side and extends in a front-back direction of the roll support plate, on which one end surface of the roll in the laterally placed state abuts, a first rolling prevention plate, which is provided to stand from a front portion of the roll support plate and extends in an inclined manner in a left-right direction of the roll support plate and in a front upward orientation, on which a front portion of the lower surface of the roll in the laterally placed state abuts, and a second rolling prevention plate, which extends in an inclined manner in parallel with the first rolling prevention plate and in a back upward orientation at an interval behind the first rolling prevention plate on the roll support plate, on which a back portion of the lower surface of the roll in the laterally placed state abuts, and a position of the second rolling prevention plate is adjustable in the front-back direction of the roll support plate.

8. The processing apparatus according to claim 5, wherein the pair of side walls are secured to the main body.

* * * * *